US007318262B1

(12) United States Patent
Florea

(10) Patent No.: US 7,318,262 B1
(45) Date of Patent: Jan. 15, 2008

(54) CASKET AND URN DISPLAY

(76) Inventor: Joshua Florea, 16948 Van Wagoner, Spring Lake, MI (US) 49456

( * ) Notice: Subject to any disclaimer, the term of this patent is extended or adjusted under 35 U.S.C. 154(b) by 0 days.

(21) Appl. No.: 11/558,073

(22) Filed: Nov. 9, 2006

(51) Int. Cl.
*A61G 17/00* (2006.01)

(52) U.S. Cl. ..... 27/19; 27/1; 27/2; 40/725

(58) Field of Classification Search ..... 27/2, 27/1, 19; 40/725, 124.5; D99/4, 5, 8
See application file for complete search history.

(56) References Cited

U.S. PATENT DOCUMENTS

| | | | | |
|---|---|---|---|---|
| 576,939 | A | 2/1897 | Baines | |
| D92,390 | S | 6/1934 | Cohen | |
| D93,349 | S | 9/1934 | King | |
| 4,324,026 | A * | 4/1982 | Craft | 27/1 |
| 4,816,302 | A | 3/1989 | Shaw | |
| 5,533,241 | A * | 7/1996 | McConnell | 27/27 |
| 5,704,103 | A * | 1/1998 | Crowley et al. | 27/1 |
| 5,727,291 | A * | 3/1998 | Biondo et al. | 27/2 |
| 5,729,921 | A * | 3/1998 | Rojas | 40/124.5 |
| 5,987,720 | A * | 11/1999 | Yamamoto | 27/35 |
| D418,961 | S | 1/2000 | Biondo et al. | |
| D445,557 | S * | 7/2001 | Chang | D99/5 |
| 6,526,636 | B2 * | 3/2003 | Bernhardt | 27/1 |
| 6,543,103 | B1 | 4/2003 | Robert | |
| 6,557,222 | B2 | 5/2003 | Groemminger et al. | |
| 6,691,385 | B2 | 2/2004 | Bell et al. | |
| 6,715,190 | B2 | 4/2004 | Groemminger et al. | |
| 6,722,001 | B2 | 4/2004 | Baker | |
| 6,836,936 | B1 * | 1/2005 | Biondo et al. | 27/2 |
| 6,898,830 | B1 * | 5/2005 | Acton et al. | 27/2 |
| 6,905,023 | B2 | 6/2005 | Au | |
| 7,082,653 | B1 * | 8/2006 | Sueppel | 27/1 |
| 2004/0040130 | A1 * | 3/2004 | Teahue | 27/19 |

* cited by examiner

*Primary Examiner*—William L. Miller
(74) *Attorney, Agent, or Firm*—John A. Waters; Varnum Riddering Schmidt Howlett LLP

(57) ABSTRACT

A casket and urn display has a floor, a top, and a perimeter sidewall. A viewable portion in the top or sidewall includes a recess in which a memorial display is mounted. The display includes a mounted butterfly mounted in a container having a viewable display panel.

13 Claims, 6 Drawing Sheets

CASKET AND URN DISPLAY

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING

Not Applicable.

BACKGROUND OF THE INVENTION

The invention relates to burial caskets and urns generally, and more specifically to an unique symbolic enhancement that serves as a memorial to its occupant, and a method for mounting same.

When an individual passes away, it is customary to display the body of the individual in a casket at a funeral home, and thereafter the casket is buried. After the casket is buried, there is little left to remind the family of the burial ceremony.

In order to provide a lasting memorial of the funeral service, some caskets include nameplates or other keepsakes mounted on the side or in a recess in the casket, with the keepsakes sometimes being removable after the funeral service to be kept or displayed by the family.

An object of the present invention is to provide an improved removable display that has enhanced ornamental and symbolic characteristics, and to provide a desirable mounting mechanism therefor.

Another object of the invention is to incorporate the ornamental and symbolic display in an urn used to maintain the ashes of an individual who is cremated.

BRIEF SUMMARY OF THE INVENTION

Accordingly, a casket or urn of the invention includes a niche mounted butterfly display that enhances the personalization of the funeral experience and serves as a symbolic reminder of the deceased.

In an exemplary embodiment of the invention, a casket has a floor, a cooperating top that is spaced from the floor, and a perimeter sidewall extending between the floor and the top. A casket interior is defined between the floor, the top, and the sidewall. The sidewall has an inner surface, an outer surface, and a thickness between the inner and the outer surfaces. The inner surface is adjacent the casket interior, while the outer surface faces away from the casket interior. A recess or niche extends through the outer surface and toward the casket interior. A display that corresponds to the niche is seated in the niche and may be defined in the nature of a shadow box. The display box has a transparent surface or panel, and the panel is placed in a position of being one of recessed relative to, flush with, and protruding from the outer surface. The display box contains and displays a mounted butterfly, which serves as an attractive memorial that symbolizes the transition of the deceased individual to a higher form of life.

In one aspect of the invention, a retainer in the form of a frame attachable to the sidewall fits over the edges of the display and holds the display item in the niche. Also, a retainer may extend between the sidewall and the display item or shadow box, and at least one fastener may fasten the retainer with the sidewall to hold the display in the niche.

In other aspects of the invention, the display may be a box with the display panel being defined by one of a transparent panel and a translucent panel. The display may also be a geometric solid that is fabricated of one of a transparent material and a translucent material. The display also may be incorporated into a recess in an urn. The display may be removable or it may be permanently mounted in an urn that is to be maintained on display.

These and other features, objects, and benefits of the invention will be recognized by one having ordinary skill in the art and by those who practice the invention, from this disclosure, including the specification, the claims, and the drawing figures.

DETAILED DESCRIPTION

Figure 1:
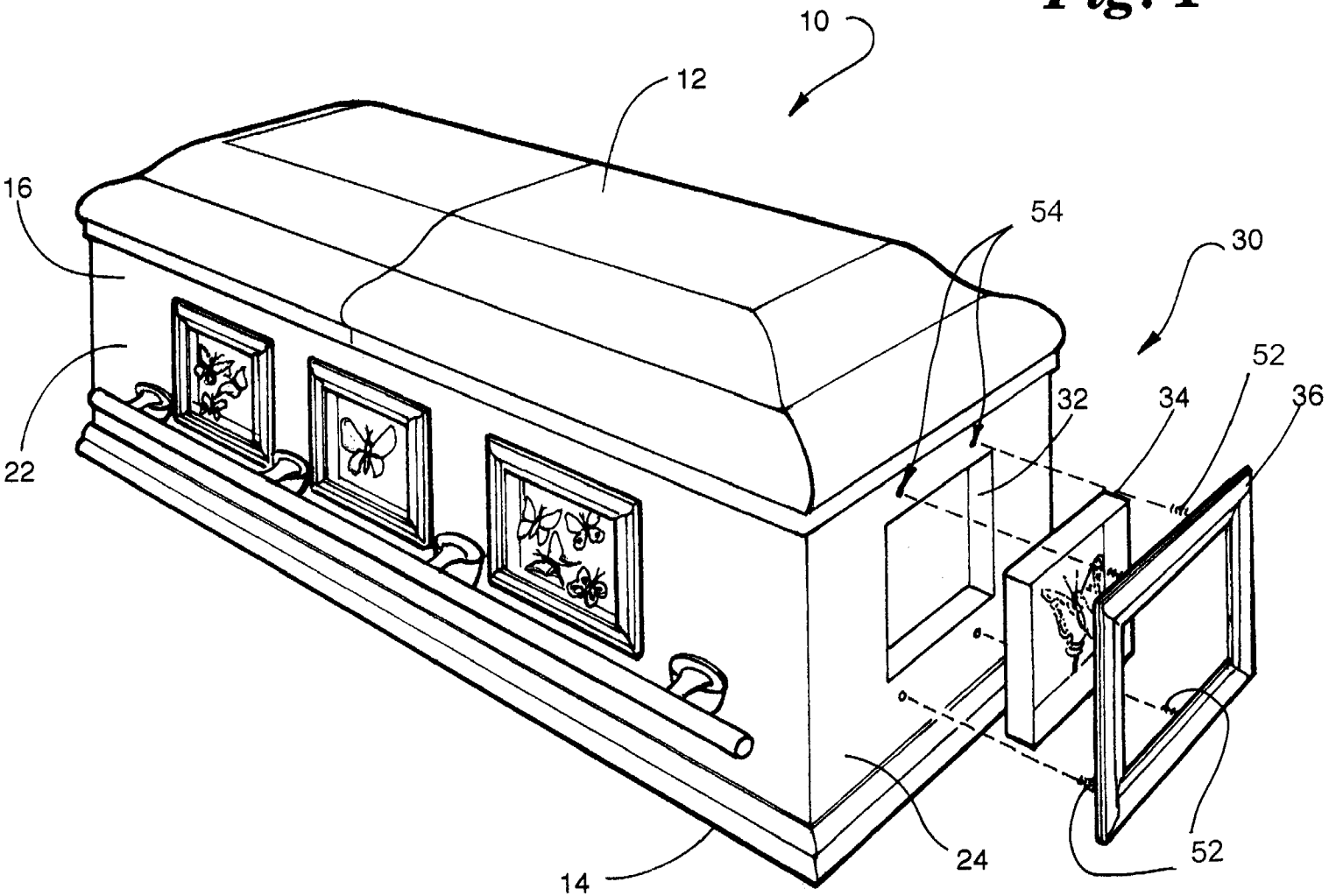
FIG. 1 is a perspective view of an exemplary embodiment of a casket with a niche display according to the invention, showing an end retaining frame removed.
Figure 3:
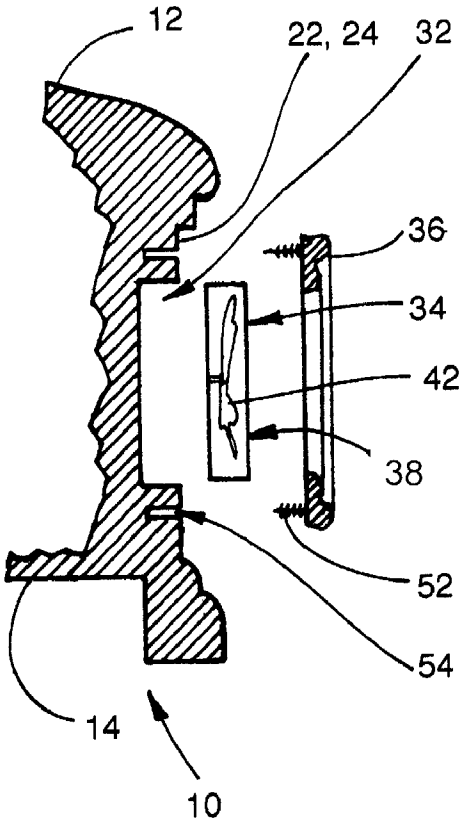
FIG. 3 is a fragmentary cross section along line III-III of FIG. 2.
Figure 2:
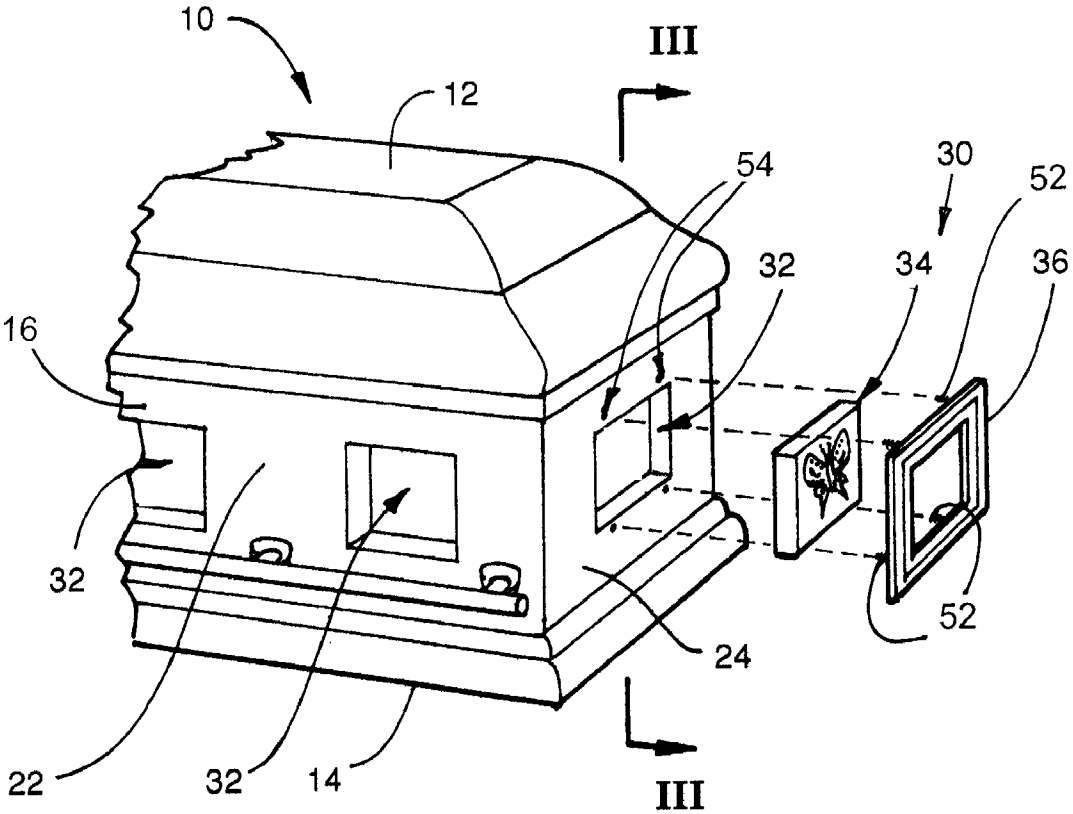
FIG. 2 is an enlarged fragmentary detail thereof with side displays being removed.
Figure 4:
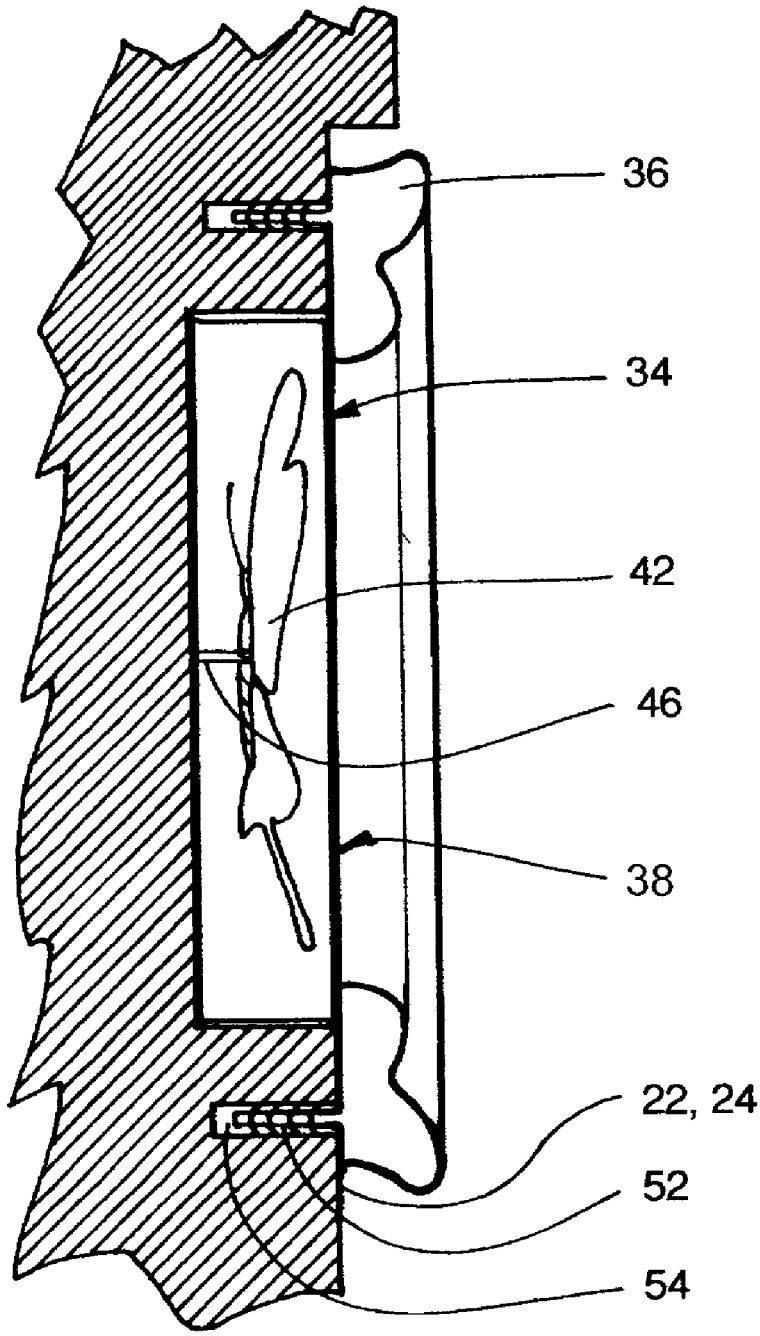
FIG. 4 is an enlarged fragmentary detail thereof, with the display and frame being mounted on the casket.

A preferred embodiment of a casket display of the present invention is generally shown in the drawing figures and discussed below. The exemplary casket 10 of the drawing includes a top 12, an opposing floor 14, and a perimeter sidewall 16. The casket may generally be constructed of suitable materials as is customary and as may be anticipated in the trade, using appropriate fabrication methods.

The perimeter sidewall 16 may extend generally perpendicularly between the floor 14 and the top 12. Thus, the sidewall, the floor and the top define a casket interior. The sidewall further has an inner surface (not shown) that is adjacent the casket interior, and an opposing outer surface (shown at 22 and 24) that faces away from the casket interior.

A recess or niche 32 may be formed at one or more locations in the perimeter sidewall or top and extend through the outer surface 22 or 24, toward the casket interior. A corresponding display or shadow box 34 is adapted to be seated in the niche. A retainer 36 fits on the outer side of the shadow box 34 to hold the shadow box in the niche. Thus, a display assembly 30 of the invention may include a combination of the niche 32, the display 34, and the retainer 36.

The display 34 desirably is releasably secured in the niche 32. While other methods of retaining the shadow box 34 in the niche 32 may be used, one desirable retainer includes a picture frame style molding 36 that overlays the casket sidewall 16 around a perimeter of the niche and extends over a perimeter edge of the shadow box to capture the shadow box in the niche. While the shadow box or display 34 is shown with a display panel 38 positioned generally flush with the outer surface 24 of the casket sidewall 16, the display panel may also be positioned to be recessed relative to the outer surface or protruding from the outer surface.

A fastener 52 or series of fasteners 52 may releasably or fixedly secure the retainer 36 in place. More specifically, the fasteners 52 may be configured as what may be commonly identified as a Christmas tree fastener (as shown), which has a longitudinal shaft and an array of radially extending flanges. An array of cooperating apertures 54 are paired and aligned with the fasteners 52. The fasteners 52 may, then, be simply pressed into the corresponding apertures 54. Depending upon the relative diametric dimensioning of the fasteners and the apertures, among other factors, mating of the fasteners in the apertures may be made to be releasable or relatively fixed as known by one having ordinary skill in the art.

The frame retainer 36 may, in one fabrication, be molded with the fasteners 52 integrally molded with the frame. An alternative fabrication of the holder may include traditional or common picture frame constructions. Another fastening system may include commonly known screw or other fastening. In the event that a casket having a display recess is to be used without a display, a frame retainer having a solid interior panel that covers the recess opening may be employed. These and various other modifications and improvements may be made without departing from the spirit of the disclosed inventive concept.

The display or shadow box 34 is a hollow closed container in which a butterfly 42 is mounted. The butterfly desirably is a real butterfly that is preserved and mounted in a clear plastic box or case. The butterfly may be mounted by itself or with other butterflies and may be positioned alone or with other materials in a natural setting. Butterfly boxes, as decoration, are commercially available.

Whatever the butterfly display selected, the shadow box 34 may be dimensioned appropriately to contain and display the objects inside the box. A butterfly may be secured in the box with a mount 46 that may extend to the butterfly from a perimeter of the display shadow box. Thus, the display is constructed with a transparent display panel 38 facing out from the niche 32.

Alternatively, the display may include a cast or molded shadow box 34 that contains the display object 42. In this fabrication, the display may be a geometric solid that is constructed of an appropriately transparent material in which the display object is embedded. The shadow box may include any desired configuration and is not limited to the rectangular solid geometry of the illustrated shadow box. Selection of the solid shadow box may facilitate arrangement in the display of various selected display objects 42 to particular and personal effect.

The use of a butterfly memorial is of particular significance. Since a butterfly represents a metamorphosis from one state of life, a caterpillar, to another and more beautiful state of life, a butterfly, the metamorphosis of a butterfly serves as a metaphor for the passing of an individual from life in this world to a more significant life in the next world. The display of a butterfly in a transparent box or shadow box thus signifies the transition through which the individual has passed. The box is removable from the casket before burial and thus serves as a permanent memorial of the deceased. The frame by which the box is mounted in the recess in the casket can easily be removed for removal of the box for burial purposes. With the frictional engagement of the frame, the frame simply is pried away from the casket and the box can thereafter be freely removed. However, when mounted, the frame covers the border of the box and creates a three dimensional display for viewing purposes. When removed, the box can be displayed on a bookshelf, wall or other display location in the home of the family of the deceased. The butterfly box can be labeled with an appropriate plaque or label that identifies the deceased and other pertinent information such as the date of birth and death.

Figure 6:
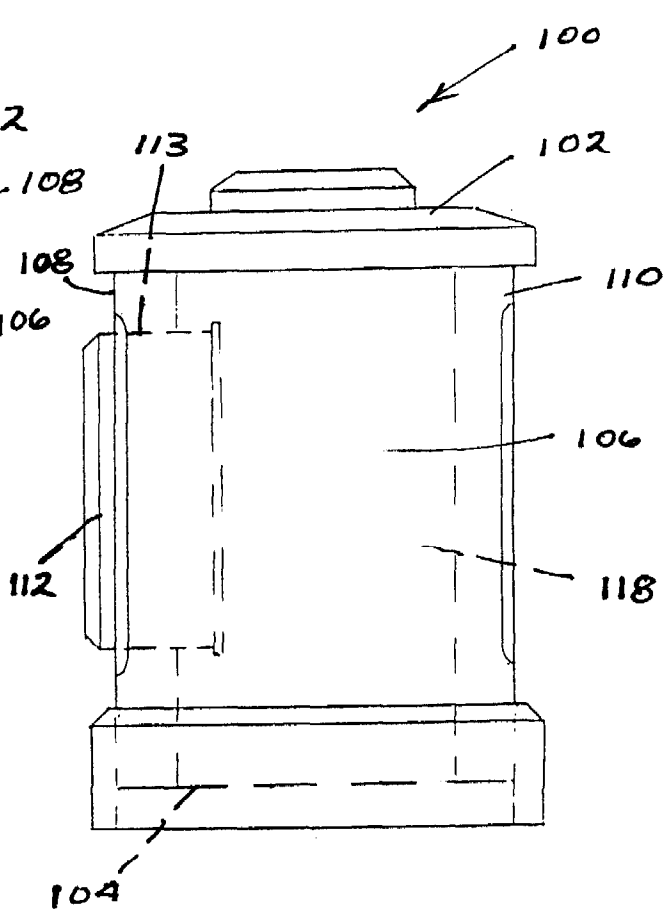
FIG. 6 is an end view of the cremation urn of FIG. 5.
Figure 5:
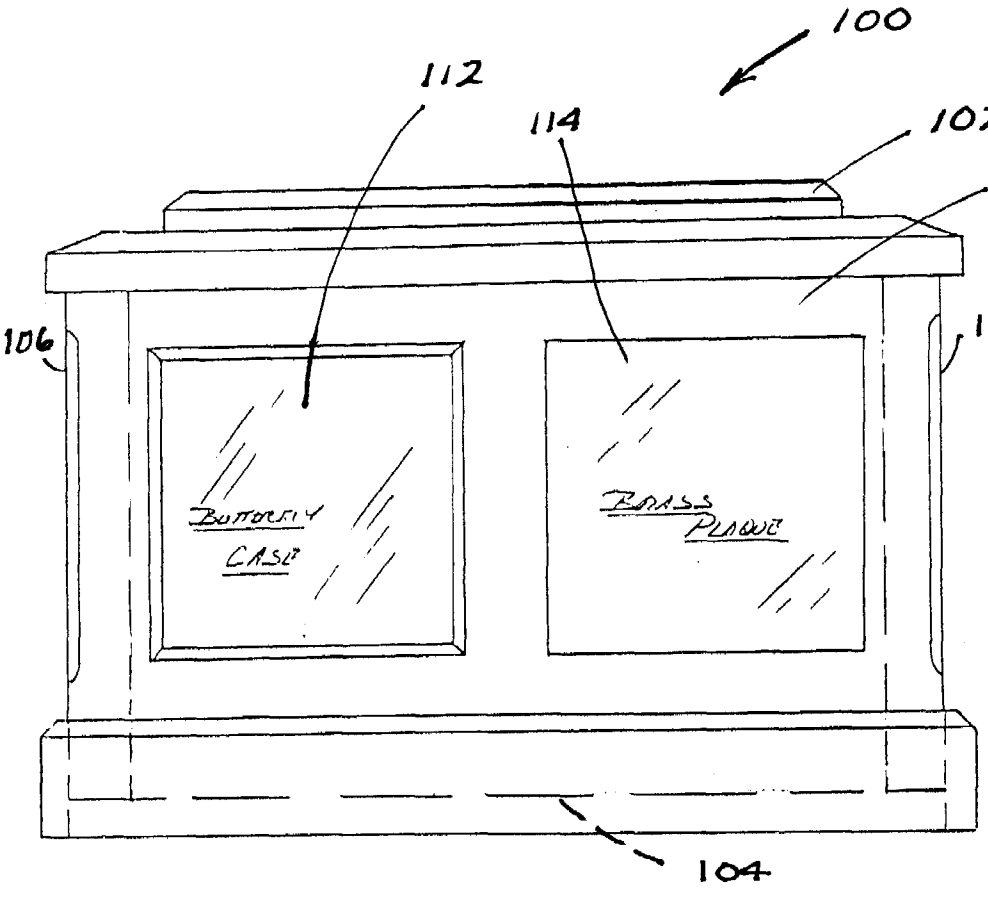
FIG. 5 is a front elevational view of mantle version of a cremation urn in which a butterfly case of the present invention has been mounted.
Figure 7:
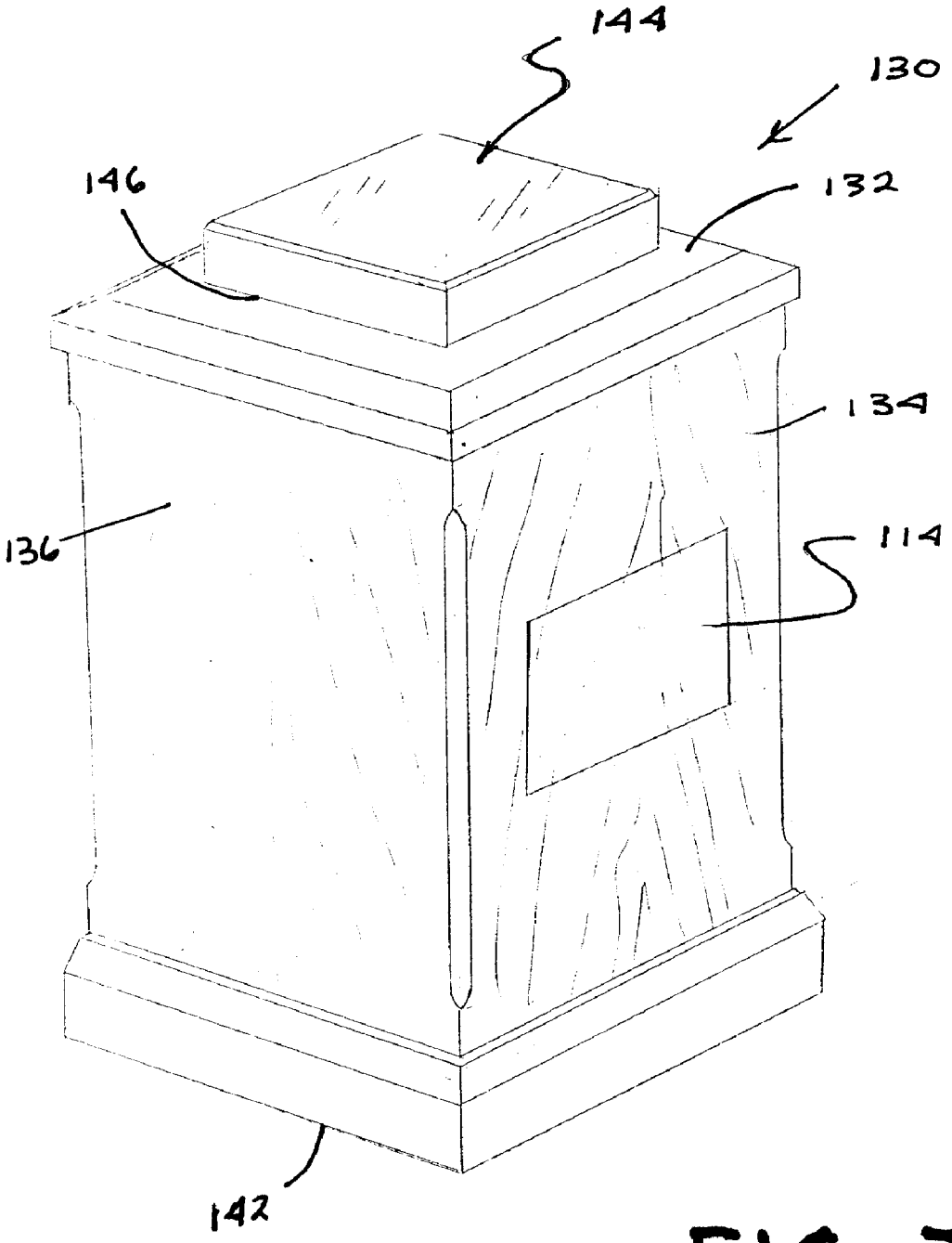
FIG. 7 is a perspective view of an alternative cremation urn employing the butterfly display of the present invention in the top panel thereof.

In another aspect of the invention, a butterfly box can also be incorporated into a cremation urn for individuals who are cremated. As shown in FIGS. 5 and 6, a rectangular urn 100, which is a mantle version of an urn, comprises a top 102, bottom 104, ends 106 and front and back panels 108 and 110. A butterfly case 112 and brass plaque 114 can be mounted side-by-side on the front panel 108. The butterfly case is mounted in a manner similar to the prior embodiment, wherein the case fits in a mating opening 113 in the front panel. Depending on the size of the butterfly case and the front panel, the case may extend all the way through the front panel or, as in prior embodiments, the opening in the panel may extend only a portion of the way through the panel.

The butterfly case typically would be somewhat smaller for the urn than for the casket, but it is possible that a single butterfly case could be used for both. The butterfly case typically would be a clear plastic container in which a butterfly display showing the butterfly in a life-like position, with or without background materials, would be displayed inside the box. One or more butterflies can be included in the same display. The display itself is available commercially.

The mantle version of the cremation urn 100 can be sized to accommodate the remains of a single person or two or more persons. In a typical case, the bottom of the urn is removable for access to the interior of the urn where the ashes of the deceased would be placed in a container in the interior 118 of the urn.

Figure 8:
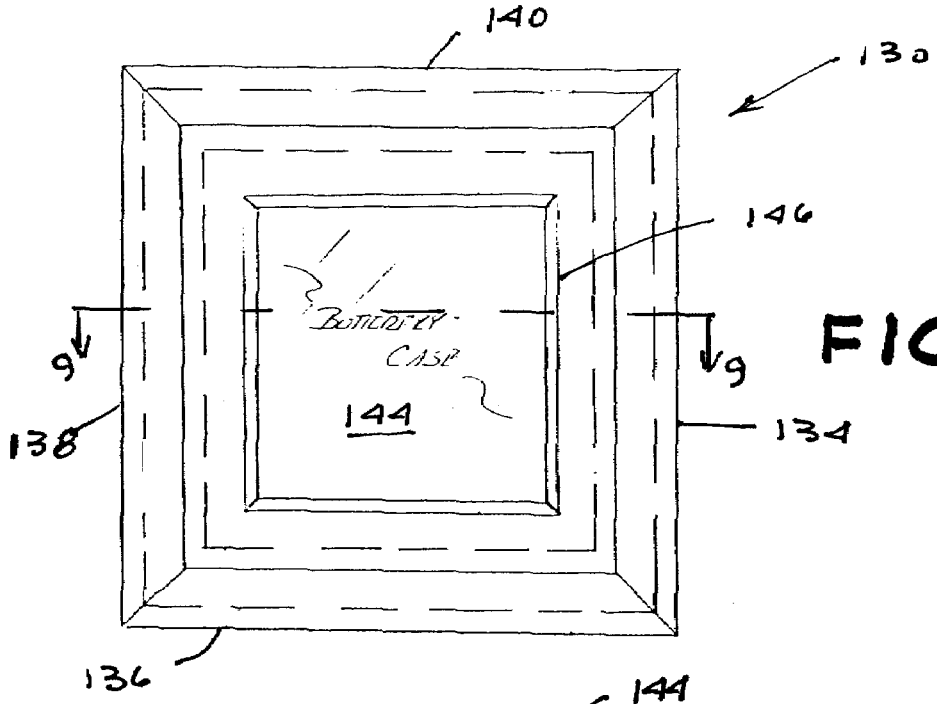
FIG. 8 is a plan view of the cremation urn of FIG. 7.
Figure 9:
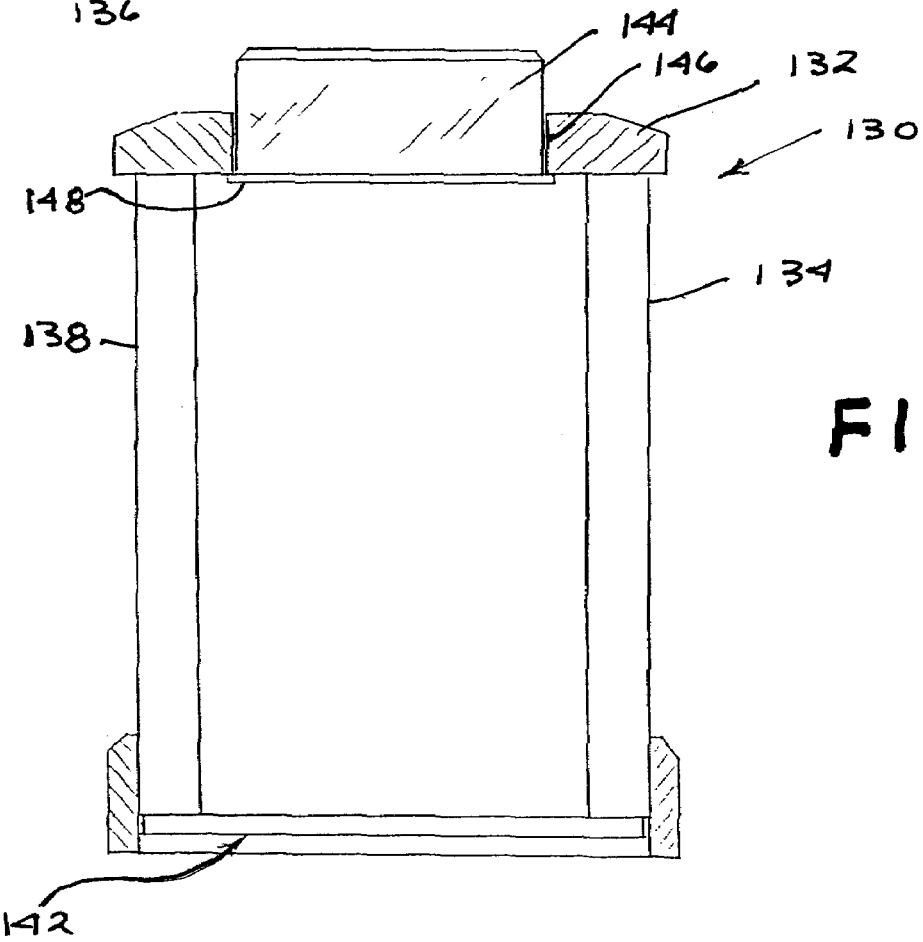
FIG. 9 is a sectional view taken along the line 9-9 of FIG. 8.

Another embodiment of the invention is represented in urn 130, shown in FIGS. 8-10. Urn 130 is square in shape (although it can be any shape) and includes a top 132 and side walls 134, 136, 138 and 140, and a removable bottom 142. A butterfly case 144 substantially as described above, can be incorporated in an opening 146 in the top 132 of the urn. If opening 146 extends all the way through the top, a plate 148 may be positioned on the underside of the top to retain the butterfly case in position in the top. Alternatively, the opening in the top may not extend all the way through the top or the case may have a flange on the lower surface that is attachable to the underside of the top. The flange of the case also could be attached to the top by fasteners or a friction connection between the sides of the case and the top.

The urn 130, having the butterfly case displayed in the top, would be more appropriately displayed at a lower location where the top of the urn is viewable. Because an urn typically is not buried but is maintained for display purposes. If maintained for display purposes, the butterfly case typically would be mounted so that it remains in position in the urn. If the urn is not to be maintained for display purposes but the butterfly case would be retained, the butterfly case is mounted in the urn in a removable manner, similar to the manner described above.

The foregoing embodiments are illustrative of the preferred practice of the present invention. Various changes in the details and arrangements of the embodiments disclosed may be made without departing from the spirit and scope of the present invention.

I claim:

1. A casket with a removable display, the casket comprising a floor, a perimeter sidewall extending generally perpendicularly from the floor, a top abutting the perimeter sidewall in a closed position, whereby a casket interior configured to receive a deceased therein is defined between the floor, the top, and the sidewall, the sidewall having an inner surface, an outer surface, and a thickness between the inner and the outer surfaces, and having a niche that extends through the outer surface and toward the casket interior, the display comprising a container that has a transparent display panel and that is seated in the niche with the display panel placed in a position of being one of recessed relative to, flush with, and protruding from the outer surface, the display containing and displaying a three dimensional object that includes a mounted butterfly, and a retainer that overlays the casket sidewall around the perimeter of the niche and extends over a perimeter edge of the display, the retainer further being releasibly attachable to the casket to hold the display in the niche.

2. The casket defined in claim 1 further including at least one fastener that fastens the retainer with the sidewall, whereby the display is held in the niche.

3. A casket with a removable display, the casket comprising a floor, a perimeter sidewall extending generally perpendicularly from the floor, a top abutting the perimeter sidewall in a closed position, whereby a casket interior configured to receive a deceased therein is defined between the floor, the top, and the sidewall, the sidewall having an inner surface, an outer surface, and a thickness between the inner and the outer surfaces, and having a niche that extends through the outer surface and toward the casket interior, the display comprising a geometric solid that is fabricated of one of a transparent material and a translucent material and that is seated in the niche with a display side of the geometric solid placed in a position of being one of recessed relative to, flush with, and protruding from the outer surface, the display being adapted to contain and to display a three dimensional object, the three dimensional object including a mounted butterfly, and the three dimensional object being viewable inside the solid.

4. A casket with a niche display, comprising:

a floor;

a cooperating top that is spaced from the floor;

a perimeter sidewall extending between the floor and the top, whereby a casket interior configured to receive a deceased therein is defined between the floor, the top, and the sidewall, the sidewall having an inner surface, an outer surface, and a thickness between the inner and the outer surfaces, and having a niche that extends through the outer surface, into the thickness, and toward the casket interior; and a display that fits in the niche, the display comprising a display panel and having a butterfly mounted in a viewable interior of the display, the display being removable for retention after the casket is buried.

5. The casket defined in claim 4 further including a retainer that overlays the casket sidewall around the perimeter of the niche and extends over a perimeter edge of the display, the retainer further being adapted to hold the display in the niche.

6. The casket defined in claim 4 further including a retainer that overlays the casket sidewall around the perimeter of the niche and extends over a perimeter edge of the display, and at least one fastener that fastens the retainer with the sidewall, whereby the display is held in the niche.

7. The casket defined in claim 4 wherein the display is a box and the display panel is defined by one of a transparent panel and a translucent panel.

8. The casket defined in claim 4 wherein the display is a geometric solid that is fabricated of one of a transparent material and a translucent material and the display panel being defined by a display side of the geometric solid.

9. A casket for containing a deceased therein, the casket having mounted thereon a removable commemorative display symbolizing the transition of the deceased individual to a higher state of existence, the casket having a recess in a viewable portion of the exterior thereof and releasable mounting means for removably mounting the display therein, the display comprising a closed box having an open interior and a transparent viewing panel on at least a viewable side of the box, a butterfly being mounted in the interior of the box so as to be viewable through the viewing panel, the butterfly representing the metamorphosis of a caterpillar from a lower to a higher state of existence and serving as a symbol for the transition of a person on death from an earthly to a heavenly state of existence, the display being removable from the casket before burial so as to serve as a commemorative memorial for the individual's survivors.

10. In a funerary vessel for containing the remains of a deceased individual or animal therein, the improvement comprising a memorial display comprising a butterfly container having a transparent display panel on at least one side thereof, the container having an interior in which a butterfly is mounted for viewing through the display panel, the memorial display being mounted in an opening or recess in a viewable exterior side of the funerary vessel wherein the vessel consists of one of the members selected from the group consisting of a casket and an urn.

11. A funerary vessel as in claim 10 wherein the vessel is the casket and the memorial display is removably mounted in the recess, such that the display can be removed from the casket before the casket is buried.

12. A funerary vessel as in claim 11 wherein the butterfly container and transparent display panel comprises a box having a transparent viewable side, the container fitting in the mating recess in the casket and being releasably retained in the recess by a frame member that fits over and covers side edges of the container and adjacent side edges of the recess in the casket, the frame being releasibly mounted on the casket by removable fasteners and mating fastener retainers in the casket.

13. A funerary vessel as in claim 12 wherein the fasteners comprise projections extending from a rear side of the frame, the fastener retainers comprising mating fastener openings in the casket, the fasteners having resilient gripping projections on sides thereof that engage and resiliently hold the fasteners in the fastener openings, the fasteners being removable by pulling the frame away from the casket with sufficient force to release the fasteners, the fasteners being releasable with a sufficiently low force that the frame can be removed by hand with at most simple hand tools, without injuring the casket or the frame.

* * * * *